US005402912A

United States Patent [19]

Gregorek

[11] Patent Number: 5,402,912

[45] Date of Patent: Apr. 4, 1995

[54] BODY FILLER DISPENSER

[76] Inventor: Tadeusz Gregorek, 32915 Wexford, Warren, Mich. 48092

[21] Appl. No.: 240,792

[22] Filed: May 10, 1994

Related U.S. Application Data

[63] Continuation of Ser. No. 952310, Sep. 28, 1992, abandoned.

[51] Int. Cl.[6] ..... B54D 88/54

[52] U.S. Cl. ..... 222/1; 222/326; 222/387

[58] Field of Search ..... 222/1, 326, 386, 387, 222/390, 327

[56] References Cited

U.S. PATENT DOCUMENTS

| | | | |
|---|---|---|---|
| 237,194 | 2/1881 | Manley | 222/387 |
| 243,884 | 7/1881 | Gulden | 222/387 |
| 858,669 | 7/1907 | Radtke | 222/326 |
| 1,761,875 | 6/1930 | Cordell et al. | 222/390 X |
| 2,096,175 | 10/1937 | Hansen | 222/390 |
| 2,659,517 | 11/1953 | Reinhardt | 222/387 X |
| 2,822,959 | 2/1958 | Soehnlen et al. | 222/390 X |
| 2,831,606 | 4/1958 | Alters | 222/601 |
| 2,866,579 | 12/1958 | Roozee | 222/390 X |
| 3,472,433 | 10/1969 | Thomas | 222/326 X |
| 3,664,508 | 5/1972 | Linder | 222/386 |
| 3,796,355 | 3/1974 | Linder et al. | 222/185 |
| 3,957,176 | 5/1976 | Marston | 222/185 |

*Primary Examiner*—Andres Kashnikow
*Assistant Examiner*—Kenneth Bomberg
*Attorney, Agent, or Firm*—Young, MacFarlane & Wood

[57] ABSTRACT

An apparatus for dispensing viscous, putty-like materials directly from a cylindrical, factory-filled can is used in conjunction with a can having one end and a hole formed in the other. A support shelf holds the can in place, the support shelf having an aperture in alignment with the hole formed in the can to allow the material therein to flow therethrough. A circular ram plate conforming in peripheral size and shape to the interior of the can is inserted into the can opening to pressurize the contents. In the preferred embodiment, a cutting knife is moved from side to side beneath the shelf to control the flow of the material from the can.

1 Claim, 3 Drawing Sheets

140
148
5D
5D 126
128
124
122
120
130

70a
70
128
30
24

142
144
146

152
200
150
40
148

BODY FILLER DISPENSER

This is a continuation of application Ser. No. 07/952,310, filed on Sep. 28, 1992, now abandoned.

FIELD OF THE INVENTION

This invention relates to dispensers for viscous materials and more particularly to a method and apparatus for dispensing such materials directly from a factory-filled container.

BACKGROUND OF THE INVENTION

Viscous, putty-like materials, such as automobile body filler, are generally supplied to users in cylindrical, factory-filled and sealed cans. To remove the material from the can, the user must remove the lid of the can and, using a trowel or other such device, reach into the can to remove material. In the case of automobile body filler, the material is then mixed with a hardening catalyst and applied to the working surface. The mechanic/user then reaches back into the can with his trowel to get more material as needed. As a result, the body filler often becomes contaminated with hardener, and the mechanic fails to completely remove the entire contents of the can before discarding it, resulting in uneconomical waste.

The prior art discloses various dispensers for viscous fluid materials. In most cases, these dispensers employ follower plates which are pushed into one end of a container and which carry a pump apparatus for delivering the fluid material to a dispenser gun. U.S. Pat. No. 3,957,176, issued May 18, 1976 to Marston, discloses a disposable putty dispenser which uses air pressure to force the material from specially made, disposable cartridges. Although the Marston device eliminates much of the disadvantage associated with prior art cans, it requires the user to invest in an expensive dispenser apparatus and a compressor. Moreover, it can only be used with body filler packaged in special cartridges.

There exists on the market manual dispensers such as the Evercoat TM unit which employs a threaded shaft and a ratcheting handle. However, this system is engineered only for use with three and five gallon containers, and the unit is heavy and substantial and must be rolled from place to place within the user/mechanic's shop on casters. At the same time, the use of smaller cans, such as one gallon cans, is increasing, creating a need for a lightweight, inexpensive dispenser that may simply be carried from place to place. U.S. Pat. No. 3,796,355, issued Mar. 12, 1974 to Linder et al, describes an apparatus for dispensing plastic material from a container, but the system has several drawbacks. First, the patent teaches only the use of a threaded crank to urge the follower plate into the can. This is fine while dispensing, but when dispensing is over, the user/mechanic must waste precious time unscrewing the crank to retrieve the emptied container from the apparatus. Additionally, the can is oriented in the apparatus to obviate the need for a valving mechanism. However, without some type of valve, material will continue to ooze out of the container when not in use, resulting in wasted and/or contaminated material.

SUMMARY OF THE INVENTION

The present invention is adapted for use with a cylindrical, factory-filled can having one end open and a hole formed in the other end.

According to the apparatus aspect of the invention, an elongated member extends upwardly from a base to support a shelf with an aperture therein. The can is placed on this shelf so that the hole formed in the can is in substantial alignment with this aperture, and a positioner is used to hold the can in place. A circular ram plate conforming in peripheral size and shape to the interior of the can is urged into the open end of the can with a force-applying mechanism attached to the upright member to pressurize the material contained therein. A cutting valve is movably mounted against the bottom surface of the shelf with a first position substantially sealing the aperture and a second position exposing the aperture to permit a flow of the material when pressurized by the ram plate. A retraction mechanism is included to return the cutting valve to the first position when the apparatus is not in use.

In the preferred embodiment of the present invention, the force-applying mechanism comprises a lever arm pivotably attached to the upright member, and a rigid member having one end pivotably attached along the length of the lever arm and the other end attached near the center of, and perpendicular to, the ram plate. In an alternative embodiment, the ram plate may be attached to a threaded rod which is turned through a threaded hole in a support arm attached to the upright member.

The cutting valve is preferably pivotably mounted to the bottom surface for side-to-side motion between the first position and the second position and includes a valve presser to keep the cutting valve pressed against the bottom surface of the shelf, while sliding, for the cleanest possible cut of the material as it passes through the hole in the can and the aperture and onto the base. The preferred embodiment also includes the addition of a scraper plate which is placed on the exposed material before the ram plate is urged into the can. The purpose of this scraper plate is to more effectively wipe the inside of the can as the ram plate is pressured therethrough.

According to the method aspect of the present invention, a method is provided for dispensing a viscous, putty-like material directly from a cylindrical factory-filled can comprising the steps of removing one end of the can, forming a hole in the other end of the can, supporting the can with the open end up and the hole end down, applying pressure by direct mechanical contact to the surface of the material exposed at the open end, and controlling the flow of the material through that hole. It is important to recognize that the can may be supported in inverted position for the method and apparatus of the present invention; i.e., by removing the bottom of the can and turning the can upside-down onto the shelf. Alternatively, with new "lipless" cans, the hole may be formed in the bottom of the can and the can placed on the apparatus in its upright position using the method of the present invention.

DETAILED DESCRIPTION OF THE INVENTION

Figure 1:
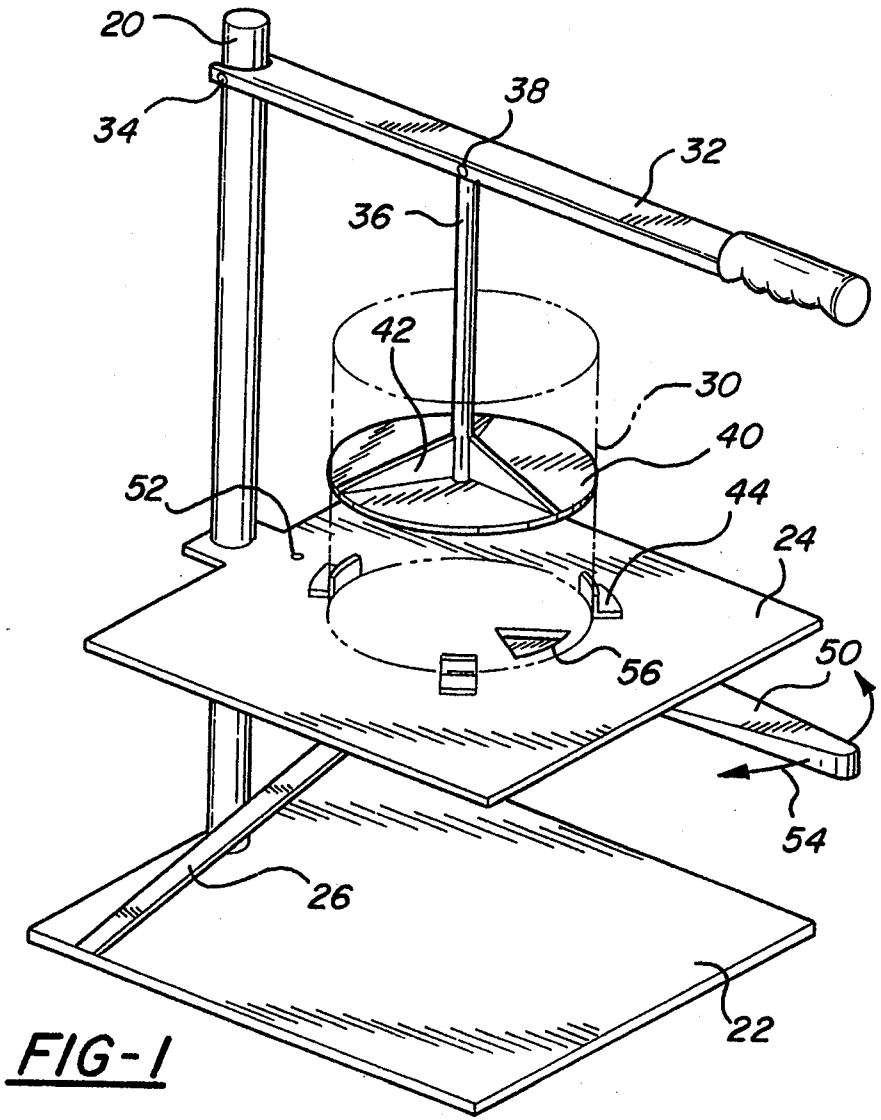
FIG. 1 shows a preferred embodiment of the present invention.

Referring now to the figures, FIG. 1 shows a preferred embodiment of the present invention. An upright member 20 is attached to a base 22, and a shelf 24 is suitably secured to member 20 in spaced overlying relation to base 22. Side supports 26 may be used for greater strength. The can from which material is to be dispensed is shown generally with broken lines 30.

In the preferred embodiment, a lever arm 32 is pivotably attached to upright member 20 at a pivot point 34. A rigid rod member 36 is pivotally attached along the length of lever arm 32 at point 38, and the other end of rigid member 36 is rigidly attached to a ram plate 40. Bosses 42 may be added to strength the connection between rigid member 36 and ram plate 40.

Tabs 44 are preferably used to hold the can indicated at 30 onto shelf 24. A cutter knife or valve 50, in the form of a flat blade member, is pivotally attached to the underside of shelf 24 at pivot point 52 and can be moved-back and forth, as shown by the arrow 54, to seal and to expose a triangular aperture 56 in the shelf 24.

Figure 2:
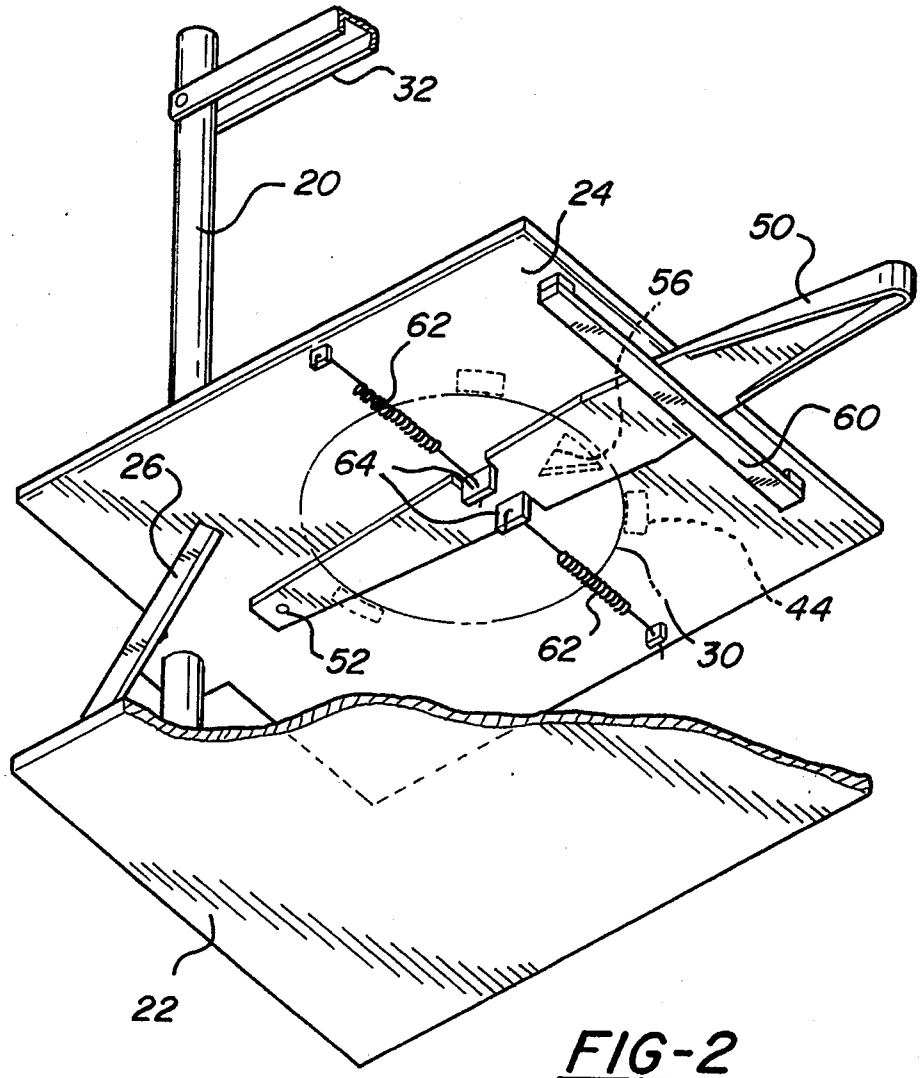
FIG. 2 shows the underside of the support shelf in the preferred embodiment of the cutting knife.

FIG. 2 shows the underside of shelf 24. Cutter knife or valve 50, pivoted at point 52, is held against the bottom surface of the shelf by a valve presser 60 in the form of a band underlying knife 50 and secured at its opposite ends to the underside of shelf 24. Cutting valve 50 is held over aperture 56 by retraction springs 62 secured to shelf 24 and to cutting valve 50 via tabs 64.

Figure 3:
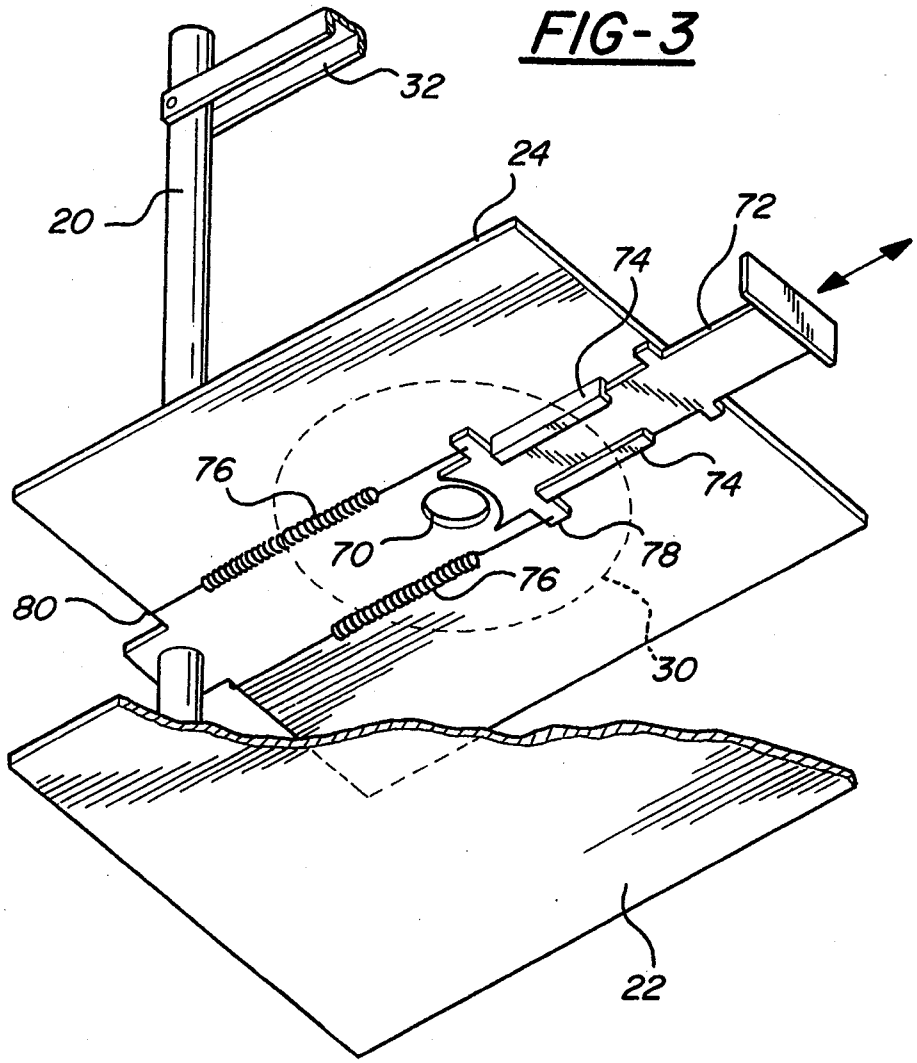
FIG. 3 shows the underside of the support shelf in an alternative embodiment of the cutting knife.

As an alternative to the side-to-side cutting valve 50 of FIG. 2, FIG. 3 shows a cutting valve 72 that slides from a first position sealing a central circular shelf aperture 70 and a second position exposing the aperture. The hole formed in the can would most likely be circular in shape and could be located near the middle of the can. Cutting valve 72 is held against the bottom surface of shelf 24 with slider guides 74. Retraction springs 76 are secured at one end to tabs 78 on cutting valve 72 and at their other ends near the edge of shelf 24 indicated at 80.

Figure 4:
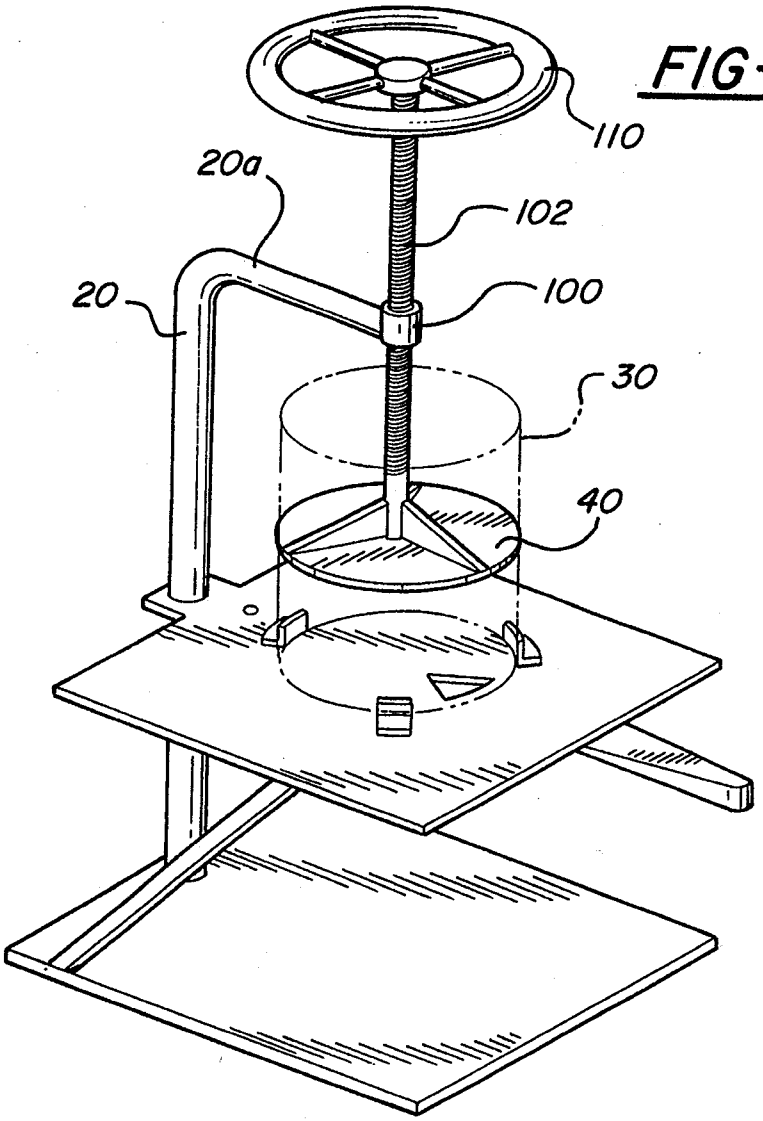
FIG. 4 shows the present invention with an alternative threaded mechanism to urge the ram plate into the factory-filled container.

FIG. 4 shows an alternative embodiment of the force-applying mechanism. In this case, upright member 20 is cranked inwardly at its upper end to form a horizontal mounting portion 20*a* and a threaded piece 100 is welded to the free end of portion 20. A threaded rod 102 is used to urge the ram plate 40 through the can (indicated with broken lines at 30) by way of a handle or wheel 110. It should be understood that various types of handles may be used in this case, and that a horizontal member from upright member 20 to threaded piece 100 may be employed in lieu of bending upright member 20.

FIGS. 5*a*–5*e* shows details of can types and help to explain the methodology of the invention.

Figures 5A, 5B, 5C, 5D, 5E:
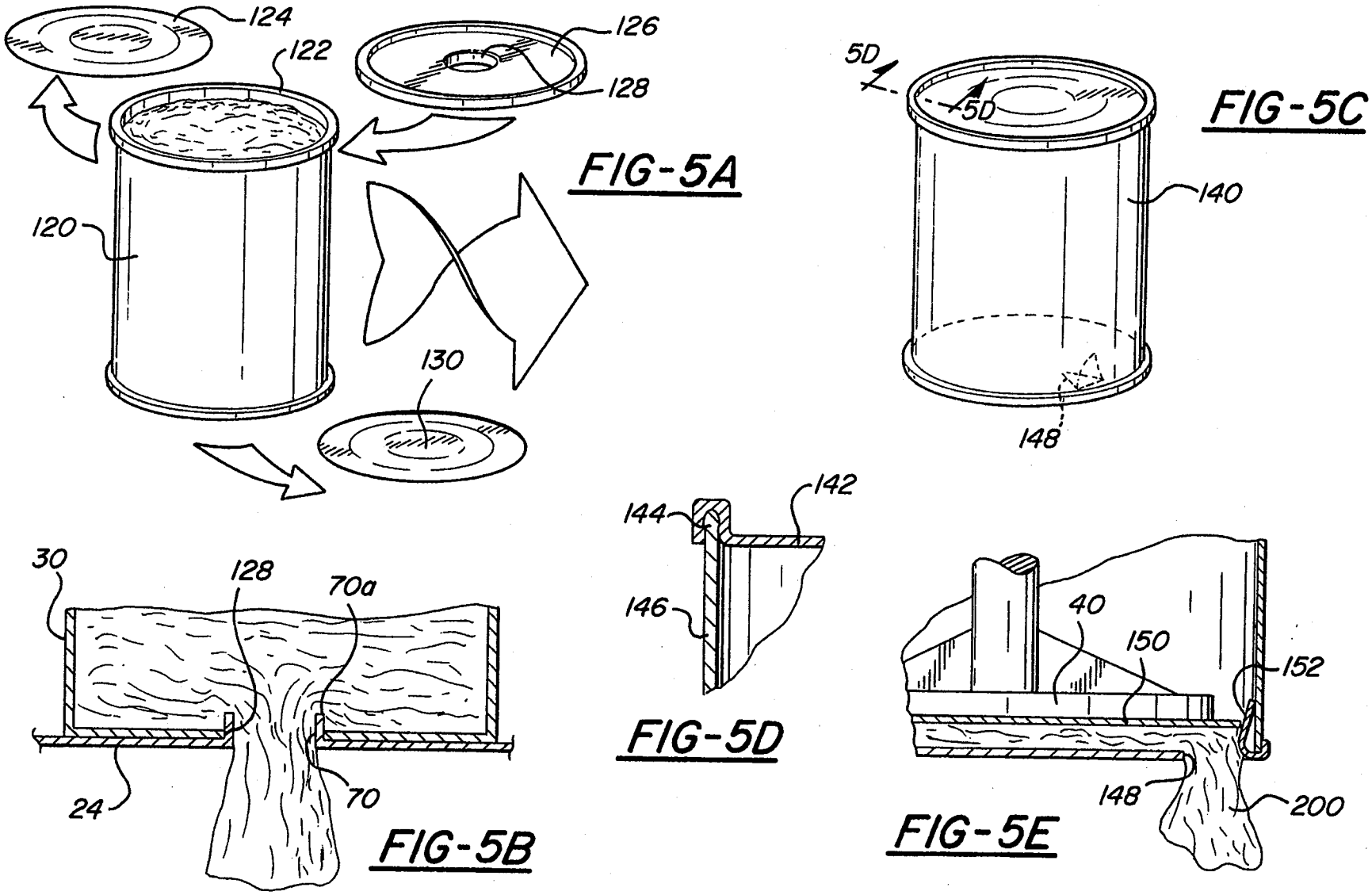
FIG. 5*a*–5*e* show can options for use with the present invention and are illustrative of the invention methodology.

FIG. 5*a* shows a standard one gallon can 120 which employs a lip along its top rim 122. In such a case, the standard lid 124 supplied with the can is removed and a new lid 126 is used having a central hole 128. Of course, it is possible for the manufacturer to supply cans with a special lid having a pull tab or the like to create hole 128 without having to remove the lid. Can bottom 130 would be removed in this case with, for example, a standard can opener, and the can would be inverted when placed on shelf 24 of the apparatus. FIG. 5*b* shows how the aperture 70 in shelf 24 may have a lip 70*a* to frictionally engage hole 128 for a cleaner flow of material through the aperture. In general, a standard one gallon can as shown in FIG. 5*a* would be used with the alternative embodiment of the apparatus shown in FIG. 3.

FIG. 5*c* shows the preferred can and helps to illustrate the preferred method of the present invention. In this case, a new type of "lipless" can 140 is utilized, usually referred to as the "Davies" type of lipless can. FIG. 5*d* shows how the top 142 is held onto a bead 144 on the side 146 of this style can. In this preferred method, the can may be placed in upright position on shelf 24 of the apparatus since a clean rimless opening to can 140 is exposed when lid 142 is removed. As such, a triangular hole 148 can be made to the bottom of the can with an implement such as a standard triangular type can opener. Alternatively, a specially made, larger type can opener can be supplied with the present invention. FIG. 5*e* shows that if the triangular metal piece, cut when forming the hole in the bottom of the can, is pressed up into the side of can 146, the ram plate may still be urged through the entire can to dispense practically all of the contents therein. In particular, a scraper plate 150 may be used between ram plate 40 and the material 200 to be dispensed. Scraper plate 150 has a size and configuration conforming to the interior of the can and is preferably made of a flexible material such as plastic so as to allow it to ride past cut tab 152 and allow a majority of material 200 to be dispensed from the can. In general, the new style lipless can depicted in FIGS. 5*c*–5*e* is intended for use with the preferred apparatus of the present invention shown in FIG. 1.

In operation, the user/mechanic opens one end of the can and forms a hole in the other end of the can either in accordance with FIG. 5*a* or FIG. 5*c*, depending upon the type of can used. Next the user/mechanic places this can on shelf 24 between tabs 44, if the preferred configuration of FIG. 1 is utilized. Cutting knife 50 will normally be positioned to close aperture 56 owing to the retraction mechanism depicted in FIG. 2.

Next the user/mechanic will preferably place plastic scraper plate 150 onto the exposed contents of the material and position ram plate 40 onto that scraper plate. Now, by applying pressure to the contents of the can with lever 32 and by selectively moving cutting knife 50 from side to side between its open and closed positions, as shown by arrow 54, material will flow through the opening in the can and aperture 56. Typically, the user/mechanic will place a piece of cardboard or the like onto base 22 to receive the dispensed material. When sufficient material has been dispensed, the user/mechanic will stop applying pressure with lever 32 and allow cutting valve 50 to move to its retracted position sealing aperture 56 and stopping the flow of material.

I claim:

1. A method of dispensing a viscous, putty-like material directly from a factory-filled can having upper and lower ends and a cylindrical side wall, said method comprising the steps of:

removing one end of the can to form an open end and expose a surface of the viscous material in the can;

forming a hole in the other end of the can;

placing the can on a support plate with the cylindrical side walls of the can in an exposed unsupported condition, the open end up, and the hole end positioned on the plate with the can hole aligned with a hole in the plate;

positioning a cutting valve beneath the support plate movable between a closed position substantially sealing the hole in the plate and an open position exposing the hole in the plate to permit a flow of material through the can hole and thereafter through the plate hole; and manually and selectively applying pressure to the surface of the material exposed at the open end while selectively controlling flow of material through the can hole under the manually applied pressure by selectively opening and closing the plate hole by selective movement of the cutting valve between its open and closed positions.

* * * * *